US010646747B2

(12) United States Patent
Liao Lai

(10) Patent No.: US 10,646,747 B2
(45) Date of Patent: May 12, 2020

(54) TWISTING EXERCISER

(71) Applicant: Shu-Chiung Liao Lai, Taichung (TW)

(72) Inventor: Shu-Chiung Liao Lai, Taichung (TW)

( * ) Notice: Subject to any disclaimer, the term of this patent is extended or adjusted under 35 U.S.C. 154(b) by 90 days.

(21) Appl. No.: 15/977,367

(22) Filed: May 11, 2018

(65) Prior Publication Data

US 2019/0344118 A1 Nov. 14, 2019

(51) Int. Cl.
*A63B 21/02* (2006.01)
*A63B 21/04* (2006.01)
(Continued)

(52) U.S. Cl.
CPC ..... *A63B 22/14* (2013.01); *A63B 21/023* (2013.01); *A63B 21/0421* (2013.01); *A63B 21/15* (2013.01); *A63B 21/4034* (2015.10); *A63B 21/4035* (2015.10); *A63B 21/4047* (2015.10); *A63B 2023/003* (2013.01)

(58) Field of Classification Search
CPC ..... A63B 2023/003; A63B 2026/006; A63B 21/0004; A63B 21/00043; A63B 21/00178; A63B 21/00185; A63B 21/023; A63B 21/0421; A63B 21/15; A63B 21/22; A63B 21/227; A63B 21/40; A63B 21/4033; A63B 21/4034; A63B 21/4035; A63B 21/4047; A63B 21/4049; A63B 22/14; A63B 22/18; A63B 2225/09; A63B 2225/093; A63B 23/02; A63B 23/0211; A63B 23/0233
See application file for complete search history.

(56) References Cited

U.S. PATENT DOCUMENTS 6,352,494 B2 * 3/2002 McAlonan ..... A63B 21/0004 472/135
7,086,992 B2 * 8/2006 Bowman ..... A63B 23/0222 482/142

(Continued)

FOREIGN PATENT DOCUMENTS

CN 203469360 U * 3/2014
CN 108704268 A * 10/2018

OTHER PUBLICATIONS

Machine Translation of Chen C, Mar. 2014, CN 203469360 U (Year: 2014).*

(Continued)

*Primary Examiner* — Andrew S Lo
*Assistant Examiner* — Scott D. Levine
(74) *Attorney, Agent, or Firm* — Thomas J. Nikolai; DeWitt LLP

(57) ABSTRACT

A twisting exerciser includes a base with a first shaft, a second shaft and a stop member respectively connected thereto. A first swingable unit and a second swingable unit are respectively and pviotably connected to the first and second shafts. The first swingable unit has a pad and first fan-shaped gear. The second swingable unit has a handle assembly and a second fan-shaped gear which is engaged with the first fan-shaped gear. The user holds the handle assembly, and the upper body and the lower body swing in opposite direction by the engagement between the first and second fan-shaped gears. The stop member limits the angle that the first fan-shape gears swings. The user may sits on the pad or stand on the pad to operate the twisting exerciser. The twisting exerciser is simple and safe.

7 Claims, 9 Drawing Sheets

(51) Int. Cl.

| | |
|---|---|
| ***A63B 21/00*** | (2006.01) |
| ***A63B 22/14*** | (2006.01) |
| ***A63B 23/00*** | (2006.01) |

(56) References Cited

U.S. PATENT DOCUMENTS

| | | | | |
|---|---|---|---|---|
| 9,199,121 | B2 * | 12/2015 | Ahn | A63B 21/00072 |
| 2009/0118106 | A1 * | 5/2009 | Leisenring | A63B 23/03516<br>482/121 |
| 2009/0227435 | A1 * | 9/2009 | Pandozy | A63B 21/4029<br>482/142 |
| 2012/0040812 | A1 * | 2/2012 | Liao Lai | A63B 23/0222<br>482/142 |
| 2018/0279793 | A1 * | 10/2018 | Derecktor | A47C 9/005 |

OTHER PUBLICATIONS

Machine Translation of You R, Oct. 2018, CN 108704268 A (Year: 2018).*

ASPTM, S355 Structural Tubing, Apr. 2016, https://www.astpm.com/285-2/ (Year: 2016).*

* cited by examiner

TWISTING EXERCISER

BACKGROUND OF THE INVENTION

1. Fields of the Invention

The present invention relates to a twisting exerciser, and more particularly, to a twisting exerciser that allows the users to twist their body by sitting on the pad or standing on the bar. The twisting exerciser includes a simple structure with reasonable manufacturing cost and meets principles of ergonomics.

2. Descriptions of Related Art

The conventional twisting exerciser generally includes a base with an active gear and a passive gear which is engaged with the active gear so as to drive the pad and the handle assembly to twist relative to each other. The user sits in the pad to exercise the muscles of the upper body and the lower body by the twisting actions.

However, there are several shortcomings found in the conventional twisting exercisers.

The distance between the upper tube and the lower tube is limited by the length of the spring between the upper and the lower tubes, and only a small distance is adjustable. The handle cannot be adjusted to a proper height for use by the user standing on the pad. Therefore, the user can only operate the twisting exerciser by sitting in the pad.

The base is composed of multiple tubes, and there is a fixed frame which is used to be connected to the active shaft. The base is bulky and complicated, and cannot be moved easily. The retractable feature of the base, and the cooperation of the active gear and the passive gear waste too much material which increases manufacturing cost.

The twisting angle is not properly limited, and the twisting angle between the pad and the handle assembly is not precisely controlled. This may cause injury to the user by overly twisting.

The bar for the feet to rest is located at a very low position which makes the user to almost vertically stretch his or her feet, and does not meet principles of ergonomics.

The present invention intends to provide a twisting exerciser that is designed to eliminate the drawbacks mentioned above.

SUMMARY OF THE INVENTION

The present invention relates to a twisting exerciser and comprises a base having a frame, a first shaft, a second shaft and a stop member respectively connected to the frame. A first swingable unit has a first fan-shaped gear, a pad and a connection bar. The first fan-shaped gear has a first sleeve which is pivotably mounted to the first shaft. The stop member limits a swinging angle of the first fan-shaped gear. The pad is secured to the top of the first sleeve. The connection bar has the first end fixed to the first sleeve, and an extension section extends upward from the second end of the connection bar. A rod is transversely connected to the extension section and located higher than the pad. A second swingable unit has a second fan-shape gear and a handle assembly. The second fan-shaped gear has a second sleeve which is pivotably mounted to the second shaft. The first and second fan-shaped gears are engaged with each other. The handle assembly has a transverse bar, a head tube and a handle. The transverse bar has the first end thereof connected to the second sleeve, and the second end of the transverse bar is connected to the lower end of the head tube. The handle has a collapsible tube extending from the center thereof. The collapsible tube is retractably connected to the top end of the head tube. The handle is adjusted to a height that that the user can hold the handle while standing on the pad.

The twisting exerciser of the present invention may adjust the handle to a height that the user can sit in the pad to hold the handle, or the handle to a height that the user can hold the handle while standing on the pad. In addition, the stop member limits the swinging angle of the first fan-shaped gear so that the user's upper body and lower body is restricted to be swung within a pre-set range of angle to avoid from being injured due to overly swinging. The rod is located on the top end of the extension section so that the feet of the user on the rod are higher than the pad, this pose meets the principles of ergonomics. Furthermore, the base is composed of the frame, the first shaft, the second shaft and the stop member. The first and second swinging units are respectively mounted to the first and second shafts, and the first and second fan-shaped gears are engaged with each other. The structure of the twisting exerciser is simplified and saves material to reduce the manufacturing cost.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
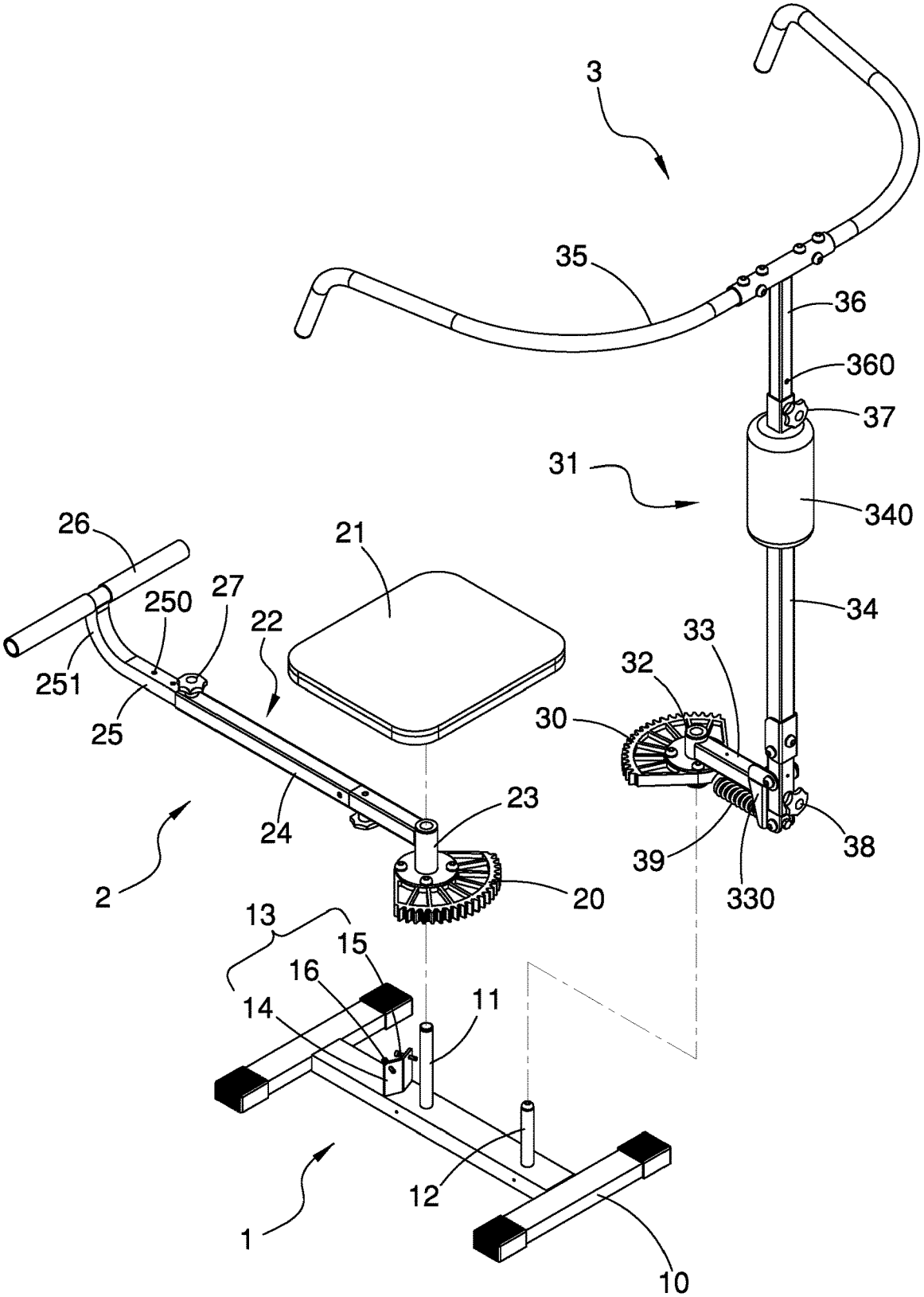
FIG. 1 is an exploded view of the twisting exerciser of the present invention.
Figure 2:
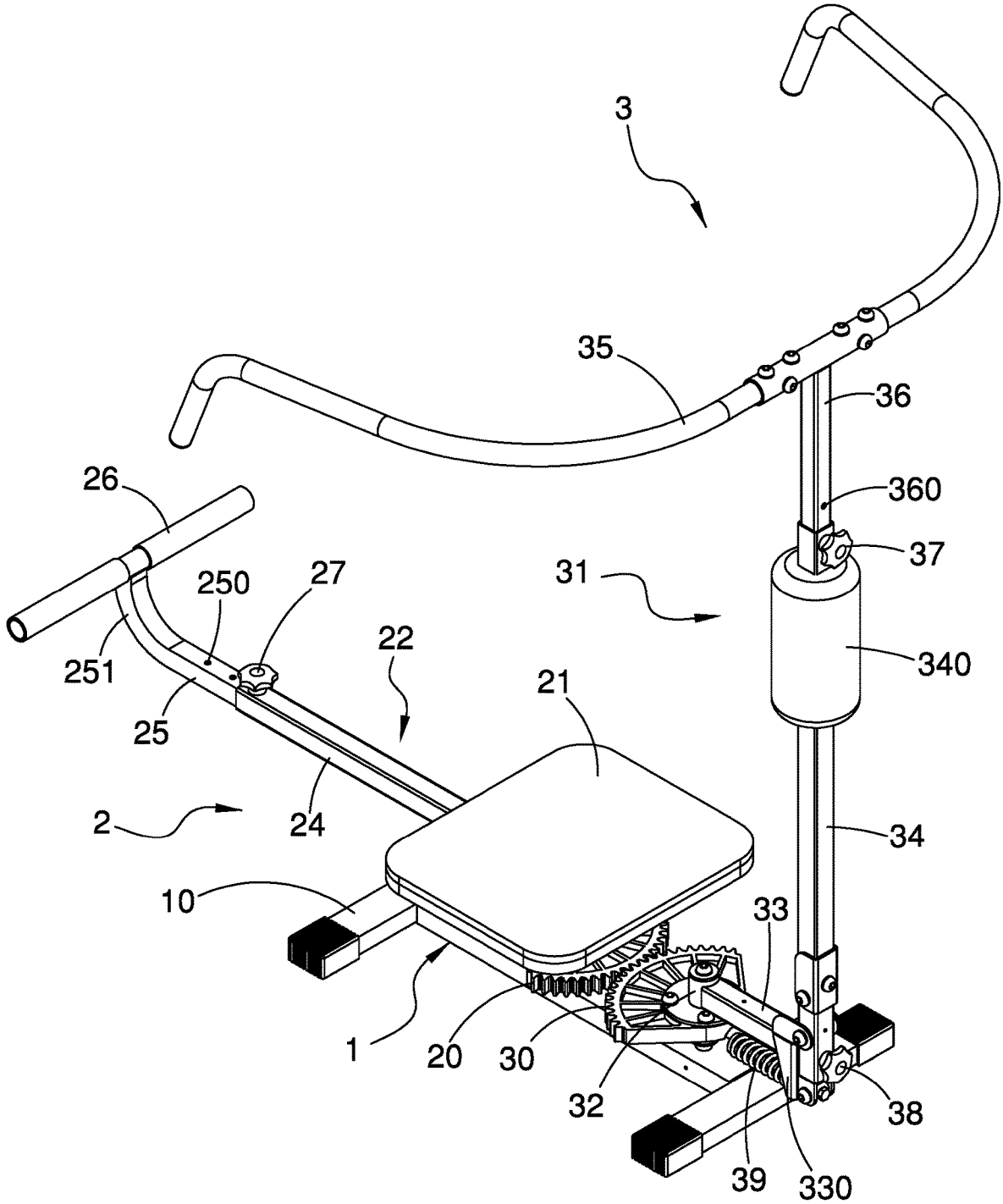
FIG. 2 is a perspective view to show the twisting exerciser of the present invention.
Figure 3:
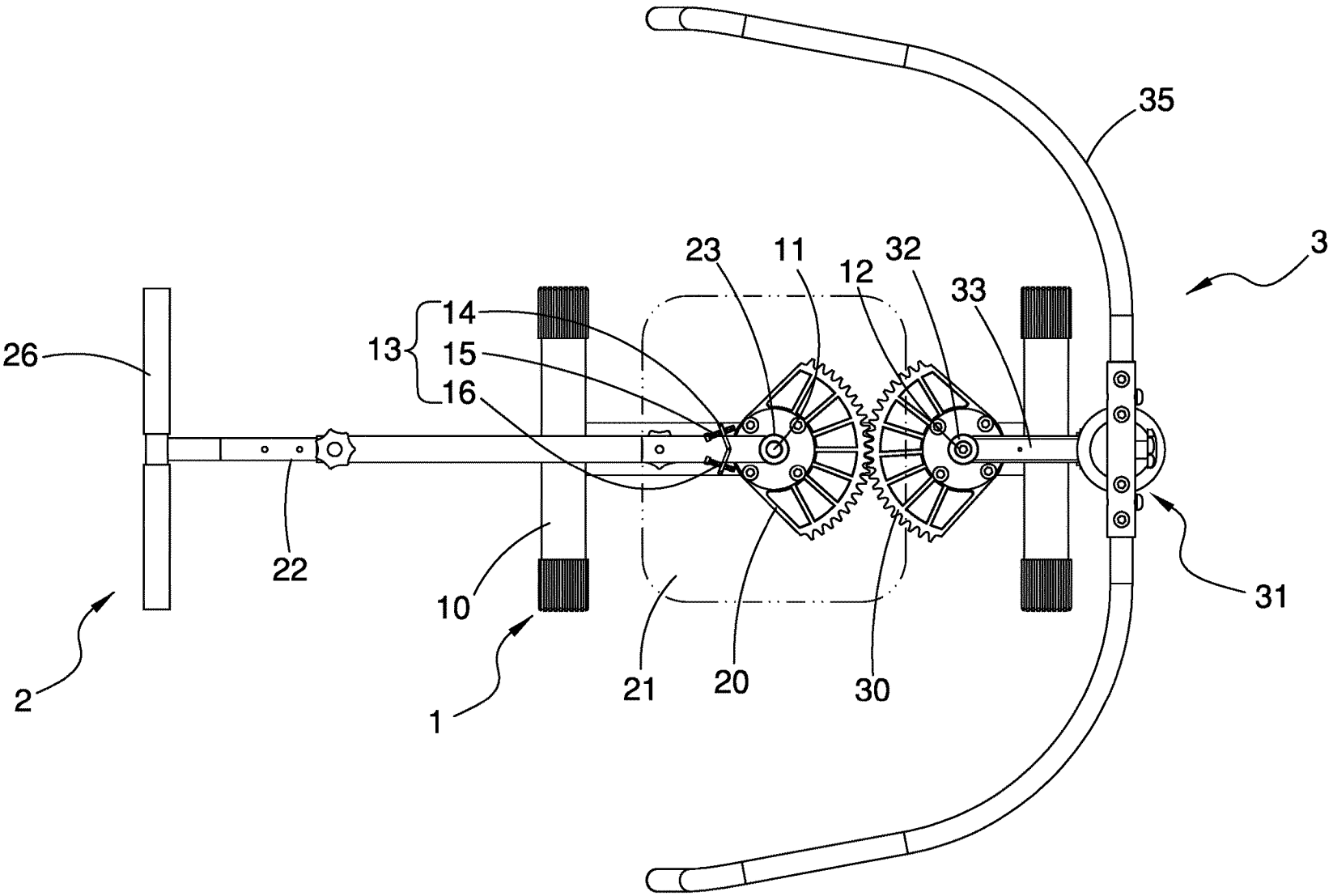
FIG. 3 is a top view to show the twisting exerciser of the present invention.

Referring to FIGS. 1 to 5, the twisting exerciser of the present invention comprises a base 1, a first swingable unit 2 and a second swingable unit 3.

The base 1 has a frame 10, and a first shaft 11, a second shaft 12 and a stop member 13 are respectively connected to the frame 10. The frame 10 is an I-shaped frame and includes multiple links. The stop member 13 includes a plate 14, and a first adjustable screw 15 and a second adjustable screw 16 are respectively and threadedly connected to the plate 14.

The first swingable unit 2 includes a first fan-shaped gear 20, a pad 21 and a connection bar 22. The first fan-shaped gear 20 has a first sleeve 23 which is pivotably mounted to the first shaft 11. The counter clockwise swinging angle of the first fan-shaped gear 20 is limited by the first adjustable screw 15 of the stop member 13. The clockwise swinging angle of the first fan-shaped gear 20 is limited by the second adjustable screw 16 of the stop member 13. The pad 21 is secured to the top of the first sleeve 23 and co-rotated with the first fan-shaped gear 20. The user may sit in the pad 21 or stands on the pad 21 to operate the twisting exerciser. The connection bar 22 has a fixed tube 24, a retractable tube 25, a rod 26 and an adjustable knob 27. The fixed tube 24 has the first end thereof fixed to the first sleeve 23. The retractable tube 25 has the first end thereof retractable connected to the second end of the fixed tube 24. The retractable tube 25 includes multiple positioning holes 250. An extension section 251 having a rectangular cross section is connected to the second end of the retractable tube 25 and extends upward from the second end of the connection bar 22. A rod 26 is connected to the distal end of the extension section 251 and located higher than the pad 21, so that the user's feet may put on the rod 26. The adjustable knob 27 of the connection bar 22 is inserted into one of the positioning holes 250 of the retractable tube 25 to adjust the retractable tube 25 to a proper length.

The second swingable unit 3 has a second fan-shape gear 30 and a handle assembly 31. The second fan-shaped gear 30 has a second sleeve 32 which is pivotably mounted to the second shaft 12. The first and second fan-shaped gears 20, 30 are engaged with each other. The handle assembly 31 has a transverse bar 33, a head tube 34 and a handle 35. The transverse bar 33 has the first end thereof connected between the second sleeve 32, and the second end of the transverse bar 33 is connected to the lower end of the head tube 34. The head tube 34 has a foam coat 340 mounted thereto. The handle 35 has a collapsible tube 36 extending from the center thereof, and the collapsible tube 36 is retractably connected to the top end of the head tube 34. The handle 35 can be adjusted to a height such that the user can hold the handle 35 while standing on the pad 21.

Figure 5:
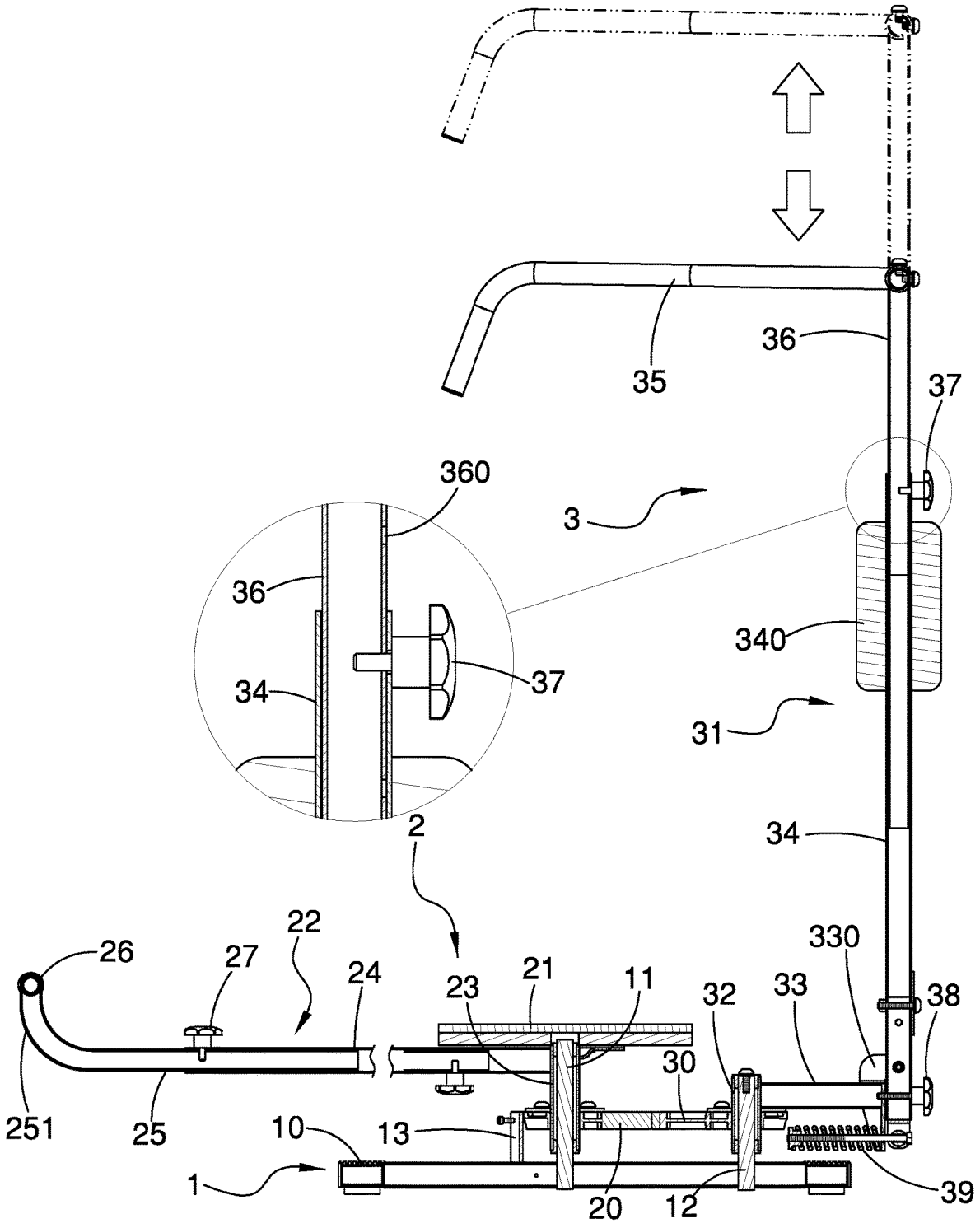
FIG. 5 shows the adjustment of the handle of the twisting exerciser of the present invention.

As shown in FIG. 5, the handle assembly 31 has an adjustable knob 37 connected to the head tube 34. The collapsible tube 36 includes multiple positioning holes 360 and the adjustable knob 37 extends into one of the positioning holes 360 in the collapsible tube 36 to adjust the height of the handle 35 so that the user can easily hold the handle 35 when sits in on the pad 21 or when stands on the pad 21 to twist his or her waist.

Figure 6:
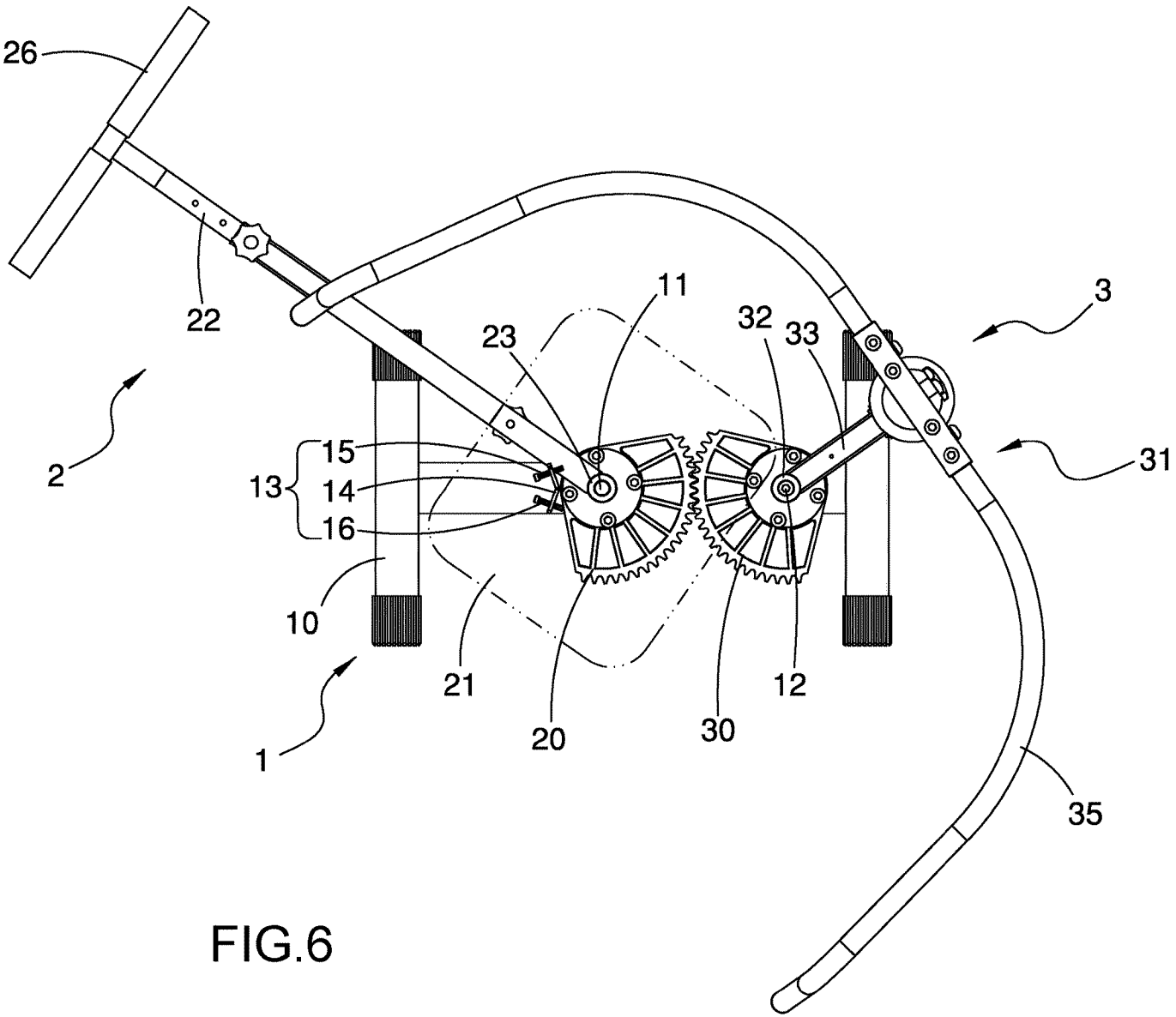
FIG. 6 shows that the handle is pivoted left while the pad is pivoted right.

As shown in FIG. 6, when the handle 35 is pivoted left, the second fan-shaped gear 30 rotates counter clockwise and the first fan-shaped gear 20 rotates clockwise. Therefore, the pad 21 and the connection bar 22 rotate right, the upper body of the user twists left and the lower body of the user twists right. When the first fan-shaped gear 20 rotates clockwise an angle, the right side of the first fan-shaped gear 20 is stopped by the second adjustable screw 16 to prevent the user from being injured due to overly twisting. Besides, the second adjustable screw 16 is able to adjust the angle of the first fan-shaped gear 20.

Figure 7:
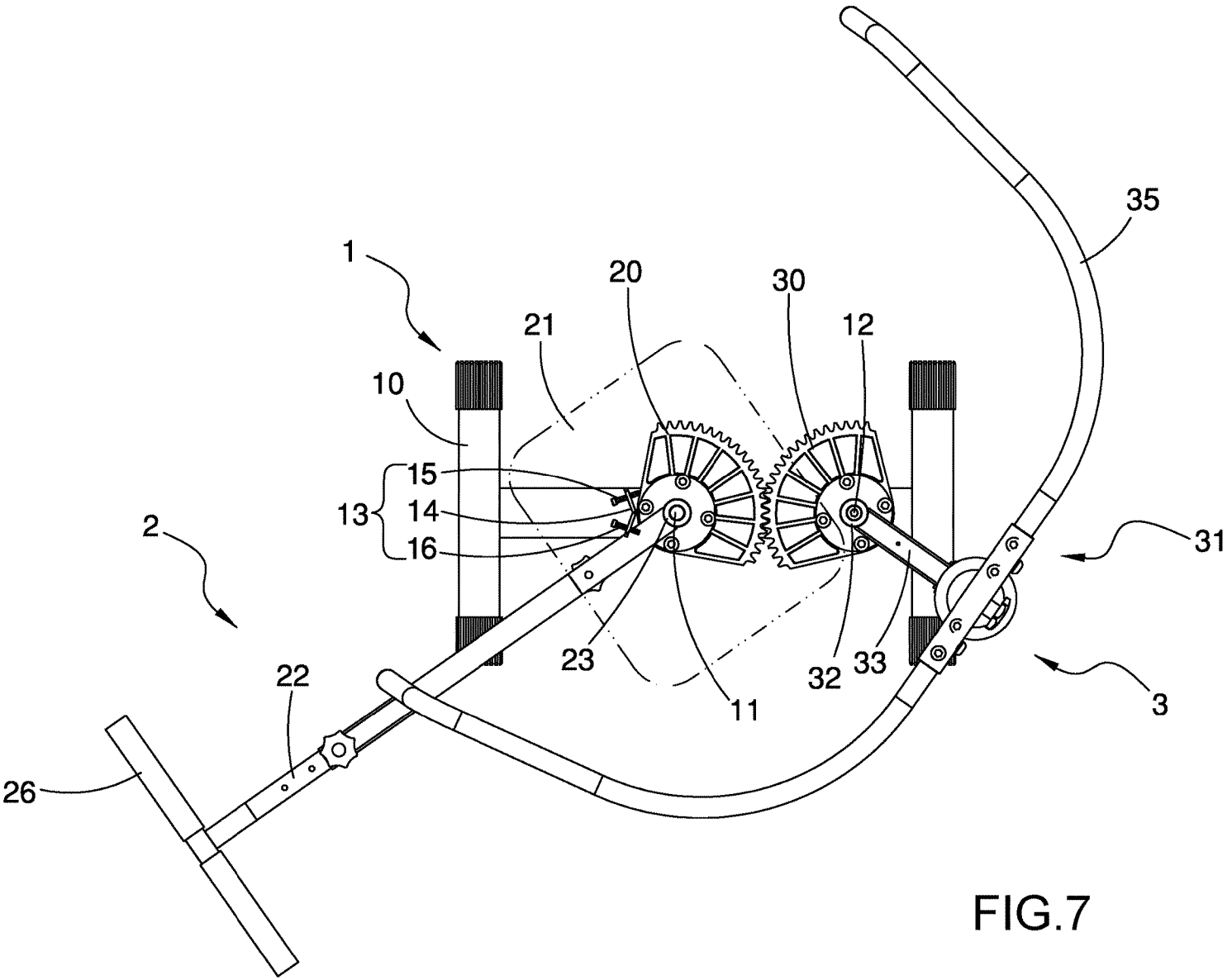
FIG. 7 shows that the handle is pivoted right while the pad is pivoted left.

As shown in FIG. 7, when the handle 35 is pivoted right, the second fan-shaped gear 30 rotates clockwise and the first fan-shaped gear 20 rotates counter clockwise. Therefore, the pad 21 and the connection bar 22 rotate left, the upper body of the user twists right and the lower body of the user twists left. When the first fan-shaped gear 20 rotates counter clockwise an angle, the left side of the first fan-shaped gear 20 is stopped by the first adjustable screw 15 to prevent the user from being injured due to overly twisting. Besides, the first adjustable screw 15 is able to adjust the angle of the first fan-shaped gear 20.

When repeating the actions as disclosed in FIGS. 6 and 7, the muscles of the waist and the back are exercised.

Figure 4:
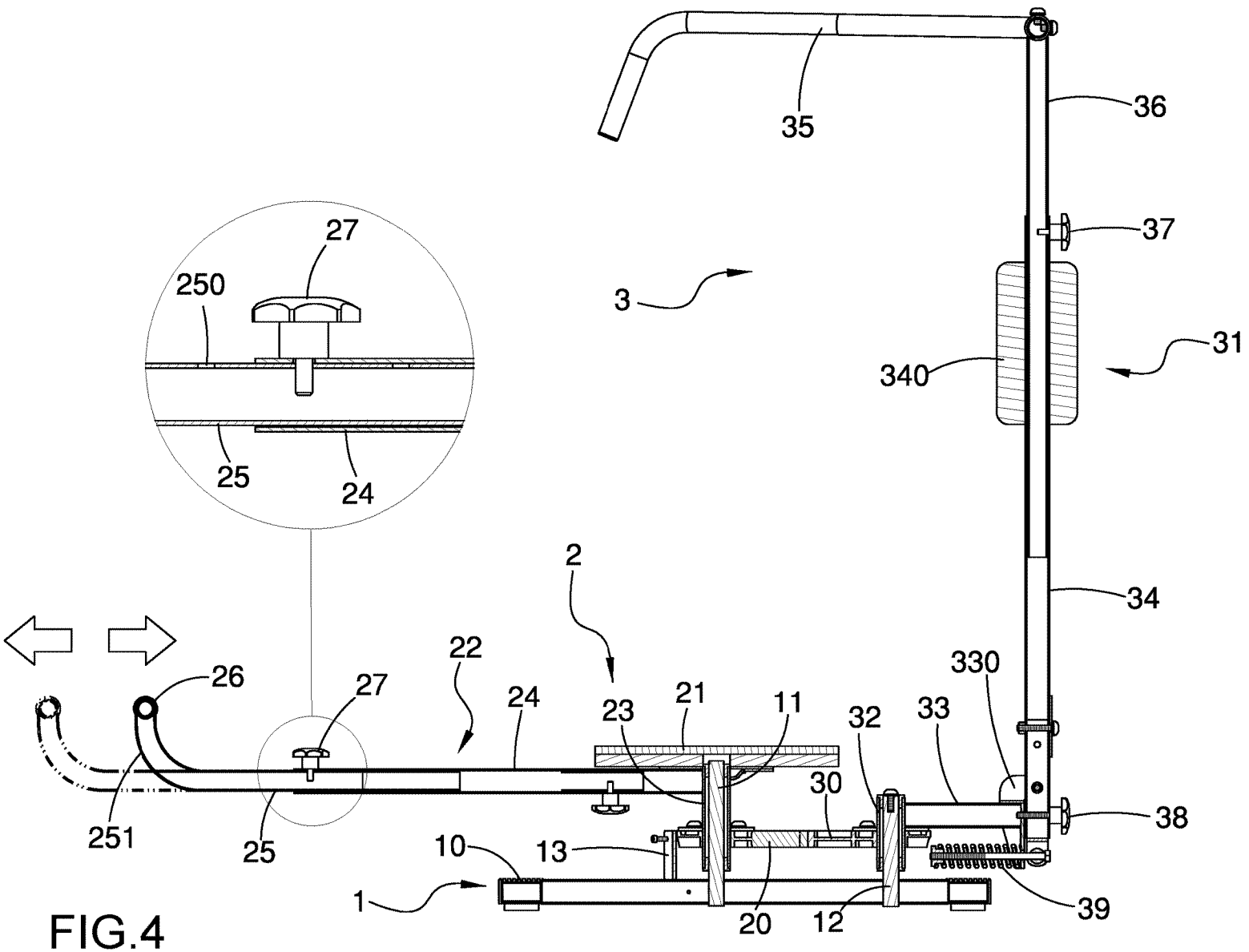
FIG. 4 is a side cross sectional view of the twisting exerciser of the present invention.
Figure 8:
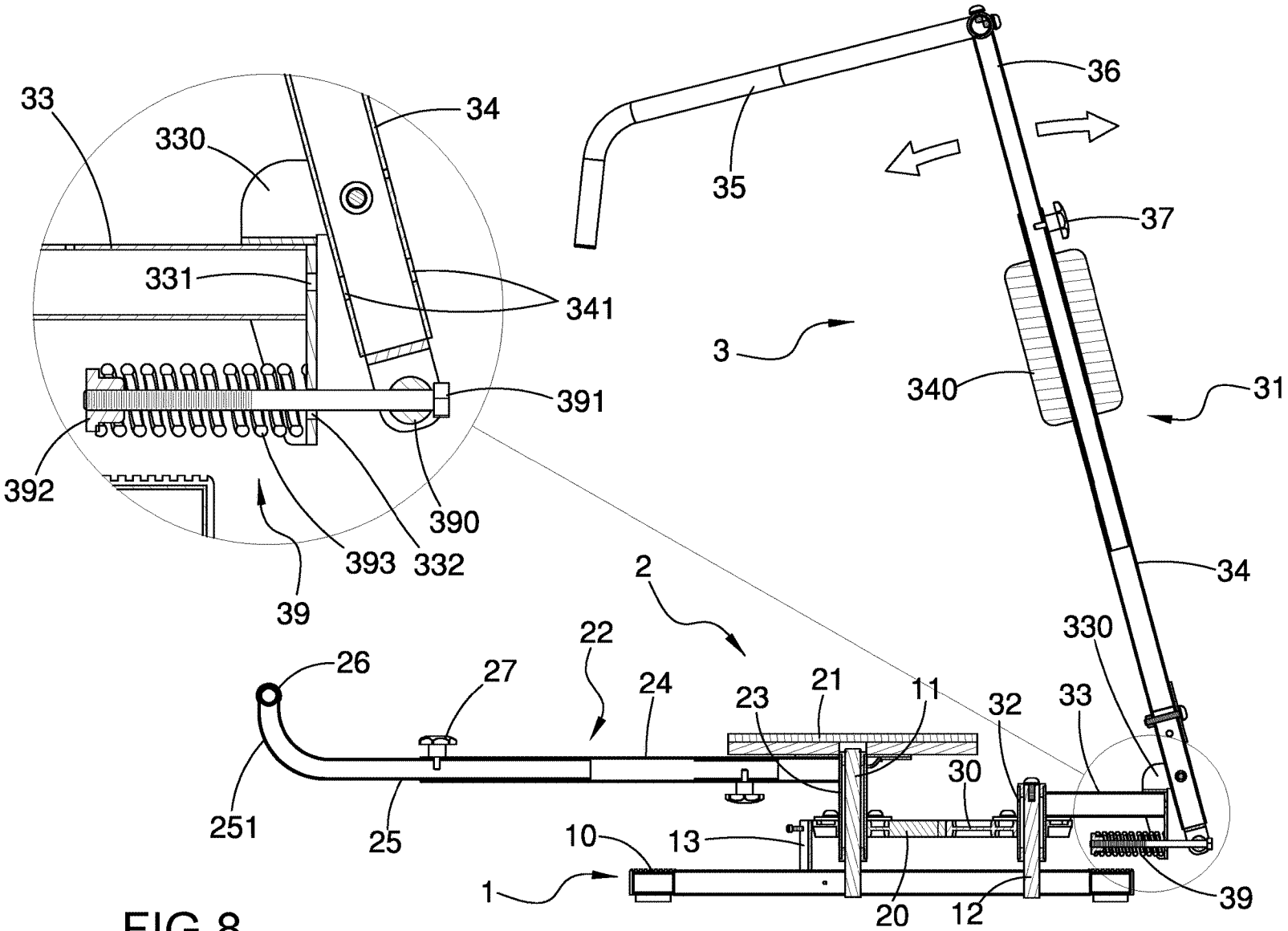
FIG. 8 shows that the handle assembly is pivoted back and forth.

As shown in FIGS. 4, and 8, the handle assembly 31 includes a bolt 38 and a resilient unit 39. The second end of the transverse bar 33 has a pivotable part 330 which has a threaded hole 331. The lower end of the head tube 34 is pivotably connected to the pivotable part 330 and has two bores 341 defined through the wall thereof. The bolt 38 extends through the bores 341 and is threadedly connected to the threaded hole 331 of the pivotable part 330 to secure the head tube 34 relative to the second end of the transverse bar 33. The resilient unit 39 is connected between the lower end of the head tube 34 and the pivotable part 330 to provide a force to return the head tube 34.

As shown in FIG. 8, the pivotable part 330 includes an elongate hole 332. The resilient unit 39 includes a pivot 390, a second bolt 391, a nut 392 and a spring 393. The pivot 390 is rotatably connected to the lower end of the head tube 34. The second bolt 391 of the resilient unit 39 extends through the pivot 390 and the elongate hole 332. The nut 392 is connected to one end of the second bolt 391 of the resilient unit 39. The spring 393 is mounted to the second bolt 391 of the resilient unit 39, and biased between the nut 392 and the pivotable part 330.

When the bolt 38 is removed from the lower end of the head tube 34 and the pivotable part 330, the user applies a force to the handle 35 to pivot the top end of the head tube 34 forward, and the spring 393 is compressed. When the force is released from the handle 35, the force from the spring 393 returns the head tube 34. By adjustment of the spring 393, the resistance of the back-and-forth action of the handle assembly 31 is adjustable.

Figure 9:
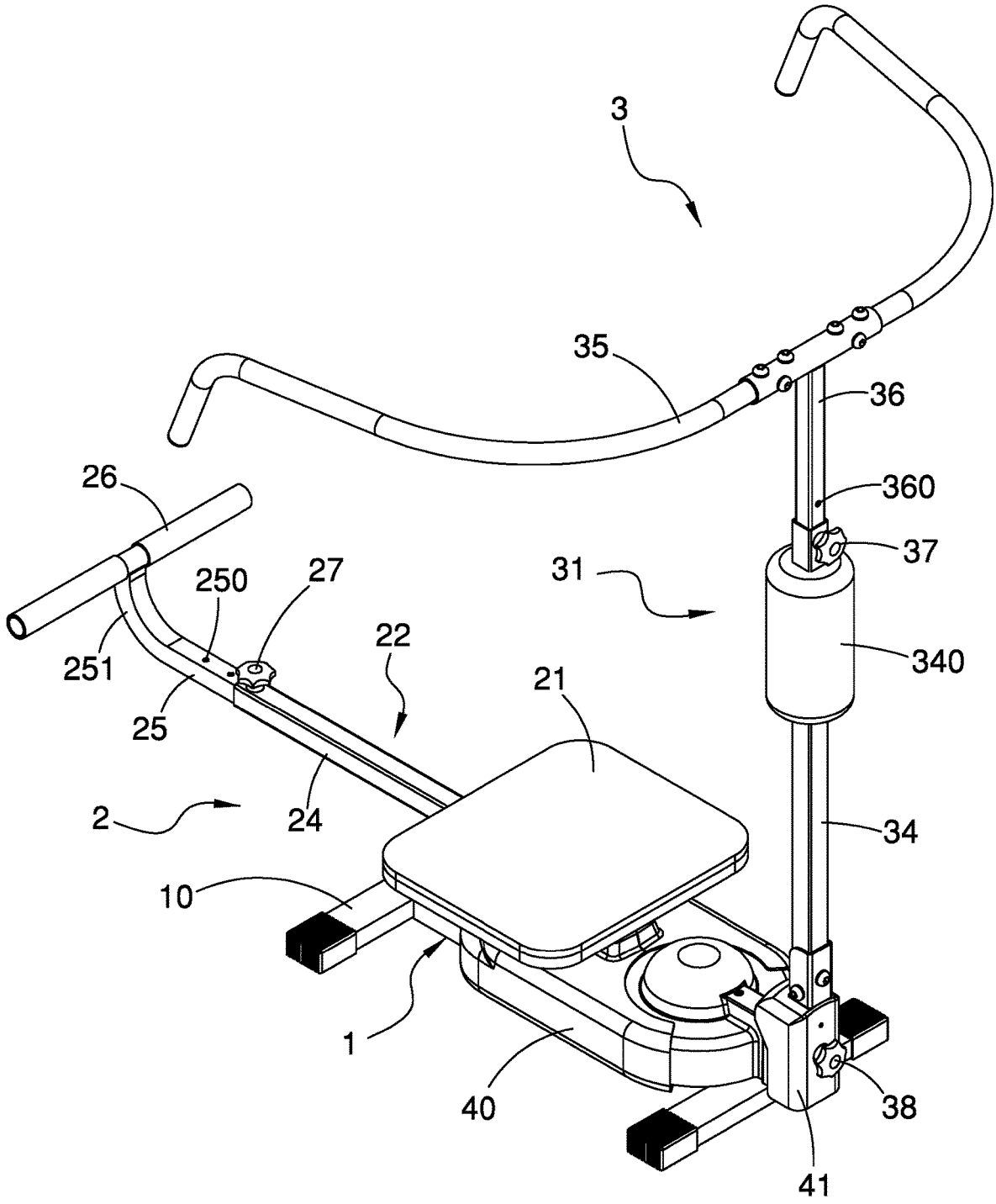
FIG. 9 shows the twisting exerciser of the present invention equipped with the first and second housings.

As shown in FIG. 9, the twisting exerciser further comprises a first housing 40 and a second housing 41, wherein the first housing 40 is mounted to the base 1 to accommodate the first and second fan-shaped gears 20, 30 therein, and the second housing 41 is mounted to the lower end of the handle assembly 31 to avoid the user's clothes from being entered into the inner parts of the twisting exerciser to cause safety problems. The first housing 40 is composed of multiple plates.

The advantages of the present invention are that the handle 35 can be adjusted to a height such that the user can hold the handle 35 while standing on the pad 21. The height of the handle 35 can also be adjusted so that the user can easily hold the handle 35 when sits in the pad 21. The user can operate the twisting exerciser when sitting or standing.

The base 1 includes the frame 10, the first shaft 11, the second shaft 12 and the stop member 13 to form an I-shaped base. The first swingable unit 2 and the second swingable unit 3 are respectively mounted to the first and second shafts 11, 12. The structure is simple and easily moved. Besides, the shape of the first and second fan-shaped gears 20, 30 save material and manufacturing cost.

The angle of the first fan-shaped gear 20 is restricted by the stop member 13 so that the angle that the upper body and the lower body of the user twists is limited to prevent the user from being injured due to overly twisting.

The extension section 251 extends upward from the connection bar 22 to locate the rod 26 slightly higher than the pad 21 or located close to the height of the pad 21, such that the feet of the user do not lower when put on the rod 26, this meets the principle of ergonomics.

While we have shown and described the embodiment in accordance with the present invention, it should be clear to those skilled in the art that further embodiments may be made without departing from the scope of the present invention.

What is claimed is:

1. A twisting exerciser comprising:

a base having a frame, a first shaft, a second shaft and a stop member respectively connected to the frame;

a first swingable unit having a first fan-shaped gear, a pad and a connection bar, the first fan-shaped gear having a first sleeve which is pivotably mounted to the first shaft, the stop member limiting a swinging angle of the first fan-shaped gear, the pad secured to a top of the first sleeve, the connection bar having a first end fixed to the first sleeve, an extension section extending upward from a second end of the connection bar, a rod transversely connected to the extension section and located higher than the pad, and a second swingable unit having a second fan-shaped gear and a handle assembly, the second fan-shaped gear having a second sleeve which is pivotably mounted to the second shaft, the first and second fan-shaped gears being engaged with each other, the handle assembly having a transverse bar, a head tube and a handle, the transverse bar having a first end thereof connected to the second sleeve, and a second end of the transverse bar connected to a lower end of the head tube, the handle having a collapsible tube extending from a center thereof, the collapsible tube retractably connected to a top end of the head tube, the handle assembly including a bolt and a resilient unit, the second end of the transverse bar having a pivotable part which has a threaded hole, the lower end of the head tube pivotably connected to the pivotable part and having two bores defined through a wall thereof, the bolt extending through the bores and threadedly connected to the threaded hole of the pivotable part to secure the head tube relative to the second end of the transverse bar, the resilient unit connected between the lower end of the head tube and the pivotable part, when the bolt is removed from the lower end of the head tube and the pivotable part, the head tube is pivotable relative to the second end of the transverse bar, the resilient unit provides a force to return the head tube, the pivotable part including an elongate hole, the resilient unit including a pivot, a second bolt, a nut and a spring, the pivot rotatable connected to the lower end of the head tube, the second bolt of the resilient unit extending through the pivot and the elongate hole, the nut connected to an end of the second bolt of the resilient unit, the spring mounted to the second bolt of the resilient unit, the spring biased between the nut and the pivotable part.

2. The twisting exerciser as claimed in claim 1, wherein the frame is an I-shaped frame and includes multiple links.

3. The twisting exerciser as claimed in claim 1, wherein the stop member includes a plate, a first adjustable screw and a second adjustable screw are respectively and threadedly connected to the plate to restrict a pivotable angle of the first fan-shaped gear.

4. The twisting exerciser as claimed in claim 1, wherein the handle assembly has an adjustable knob connected to the head tube, the collapsible tube includes multiple positioning holes and the adjustable knob extends into one of the positioning holes in the collapsible tube to adjust a height of the handle.

5. The twisting exerciser as claimed in claim 1, wherein the head tube has a foam coat mounted thereto.

6. The twisting exerciser as claimed in claim 1, wherein the connection bar has a fixed tube, a retractable tube and an adjustable knob, the fixed tube has a first end thereof fixed to the first sleeve, the retractable tube has a first end thereof retractably connected to a second end of the fixed tube, the retractable tube includes multiple positioning holes, the extension section is connected to a second end of the retractable tube, the rod is connected to a distal end of the extension section, the adjustable knob of the connection bar is inserted into one of the positioning holes of the retractable tube.

7. The twisting exerciser as claimed in claim 1 further comprising a first housing and a second housing, the first housing is mounted to the base to accommodate the first and second fan-shaped gears therein, the second housing is mounted to a lower end of the handle assembly.

* * * * *